United States Patent [19]

Morita

[11] 4,367,048

[45] Jan. 4, 1983

[54] SLURRY STORAGE TANK

[75] Inventor: Minoru Morita, Kodaira, Japan

[73] Assignee: Tsukishima Kikai Co., Ltd., Tokyo, Japan

[21] Appl. No.: 271,617

[22] Filed: Jun. 8, 1981

[30] Foreign Application Priority Data

Jun. 12, 1980 [JP] Japan ..... 55-082292

[51] Int. Cl.[3] ..... B10F 7/16

[52] U.S. Cl. ..... 366/137; 366/177; 366/312; 366/325; 210/528

[58] Field of Search ..... 366/137, 177, 312, 313, 366/325; 210/525, 528, 803; 74/421 A, 421 R

[56] References Cited

U.S. PATENT DOCUMENTS 3,333,695 8/1967 Van Note ..... 210/528 X 3,704,865 12/1972 Kharitonov et al. ..... 366/137 X

*Primary Examiner*—Billy J. Wilhite

*Assistant Examiner*—Michael Knick

*Attorney, Agent, or Firm*—Darby & Darby

[57] ABSTRACT

A slurry storage tank comprises a central vertical column arranged therein. A drive mechanism is mounted on the upper portion of the column. A plurality of rake arms with rake elements are arranged within the tank adjacent to its bottom. The rake arms are slowly rotated about the column by the drive mechanism to direct the lower portion of the slurry toward the side wall of the tank. The slurry is withdrawn from the lower portion of the tank by a pumping means and delivered through a pipe means to a plurality of vertical guide pipes supported by the top wall of the tank and extending into the tank. The withdrawn slurry is distributed over the entire surface of the slurry in the tank through the guide pipes to thereby maintain the slurry in the tank in a homogeneous state.

5 Claims, 2 Drawing Figures

SLURRY STORAGE TANK

BACKGROUND OF THE INVENTION

1. Field of the Invention

This invention relates to a slurry storage tank for holding a slurry, having a suspended sedimentatable solid material, in a homogeneous state.

2. Prior Art

Conventionally, freight trains, trucks, belt conveyers and the like have been used to transport a solid material such as coal, iron ore and non-ferrous metal. Such transportation required much time and labor for loading and unloading. For this reason, a pipeline transportation has now been extensively used. In this transportation method, the solid material in pulverized form is suspended in water to provide a slurry, and the slurry is transported through the pipeline. The slurry is transported to a distant station where a large amount of slurry is stored in storage tanks for a long period of time. Such storage tanks usually have a capacity of 1000 to 50000 tons. It is important that the slurry in the storage tank is maintained in a homogeneous state when the slurry is withdrawn from the storage tank and delivered to a processing installation. In the case where the suspended solid particles become settled to the bottom of the storage tank, the slurry can not be continuously withdrawn from the storage tank so that the supply of the starting material or slurry to the processing installation is interrupted. As a result, the intended process can not be carried out. Even if the slurry can be supplied to the processing installation, the intended process is adversely affected because there is a considerable change in concentration of the slurry.

When the solid material is pulverized to a predetermined particle size and is suspended in water to form a slurry having a predetermined concentration, the suspended particles will interfere with one another so that the sedimentation rate of the suspended solid material is very low. Although the addition of a surface active agent is advantageous in preventing the solid material from settling to the bottom of the storage tank, the use of such a surface active agent is not desirable from an economical point of view.

The speed at which the suspended solid material falls toward the tank bottom is usually adjusted to 0.1 to 1 m per hour. Therefore, in order that the solid material may not be separated from the liquid carrier to such an extent that an interface is formed, and that the concentration of the slurry may not differ from one portion to another, it is necessary to move the slurry upwardly at a speed greater than the speed of falling of the solid material. For example, the speed of falling of the solid material is not more than 1 m per hour, the rate of movement of the slurry should be above 1 m per hour to keep the slurry in a substantially homogeneous state.

One known storage tank is provided with a propeller type agitator for keeping a slurry in motion at a predetermined rate as described above, the agitator being mounted on the side wall of the storage tank. This conventional storage tank has been found not entirely satisfactory, however, in that an adequate agitation can not be achieved in the central portion of the tank where the tank is of a large size. As a result, the solid material tends to deposit on the central portion of the tank bottom. This is true particularly when liquids of high vicosity such as heavy oil are employed.

Another conventional storage tank has a vertically disposed agitator arranged centrally within the storage tank. This conventional storage tank has also been found not wholly satisfactory in that a considerable power is required for operating the agitator. For example, where the agitator is operated by a turbine for agitating a dense slurry, it requires an agitating power of 1 to 2 $KW/m^3$.

The present inventor has found that a slurry, which contains a solid material of a predetermined particle size and has a predetermined concentration, can be maintained in a homogeneous state by slowly circulating the slurry at a predetermined rate through external pipes. Thus, the slurry can be maintained in a homogeneous state without vigorously agitating the slurry. This circulation is carried out by withdrawing the slurry from the lower portion of the storage tank and pumping back to the surface of the slurry in the storage tank at such a rate that a given portion of the slurry in the tank slowly moves downwardly. This method is suitably carried out even if the storage tank is of a large size so long as the slurry in the storage tank is not subjected to considerable irregular motion. It has also been found that when a certain kind of slurry, for example, such as a slurry prepared by suspending powder coal in oil and containing a surface active agent to stabilize the suspension of the powder coal, is subjected to vigorous agitation, the stabilization of the slurry is rather affected adversely. Thus, in such a case, vigorous agitation is not suitable for preventing the sedimentation.

SUMMARY OF THE INVENTION

It is an object of this invention to provide a slurry storage tank of the circulating type which is capable of maintaining a slurry in a homogeneous state without vigorous agitation.

According to the invention, there is provided a slurry storage tank for holding a slurry having a suspended sedimentable solid material, the tank having a cylindrical side wall, a flat bottom wall and top wall, the tank comprising a hollow cylindrical column arranged centrally within the tank and fixedly secured at its lower end to the tank bottom wall, the column extending through the tank top wall at its upper portion; a drive mechanism mounted on the upper portion of the column; a connecting means operatively connected at its one end to the drive mechanism and extending downwardly toward the tank bottom wall; a plurality of rake arms connected to the lower end of the connecting means and extending radially outwardly relative to the column, the rake arms being rotated at a low speed by the drive mechanism through the connecting means, each of the rake arms having at its underside a plurality of rake elements for directing the lower portion of the slurry on the bottom wall radially toward the tank side wall; a pumping means located exteriorly of the tank; a first pipe means connected between the suction side of the pumping means and the lower portion of the tank side wall for withdrawing the slurry from the tank; a second pipe means connected at one end to the delivery side of the pumping means and extending to a position above the tank top wall; and a plurality of vertical guide pipes connected to the other end of the second pipe means, the guide pipes extending through the tank top wall into the tank and arranged radially and circumferentially of the column for distributing the slurry over the entire surface of the slurry in the tank whereby the slurry in the tank is maintained in a homogeneous state.

DESCRIPTION OF THE PREFERRED EMBODIMENT OF THE INVENTION

Figure 1:
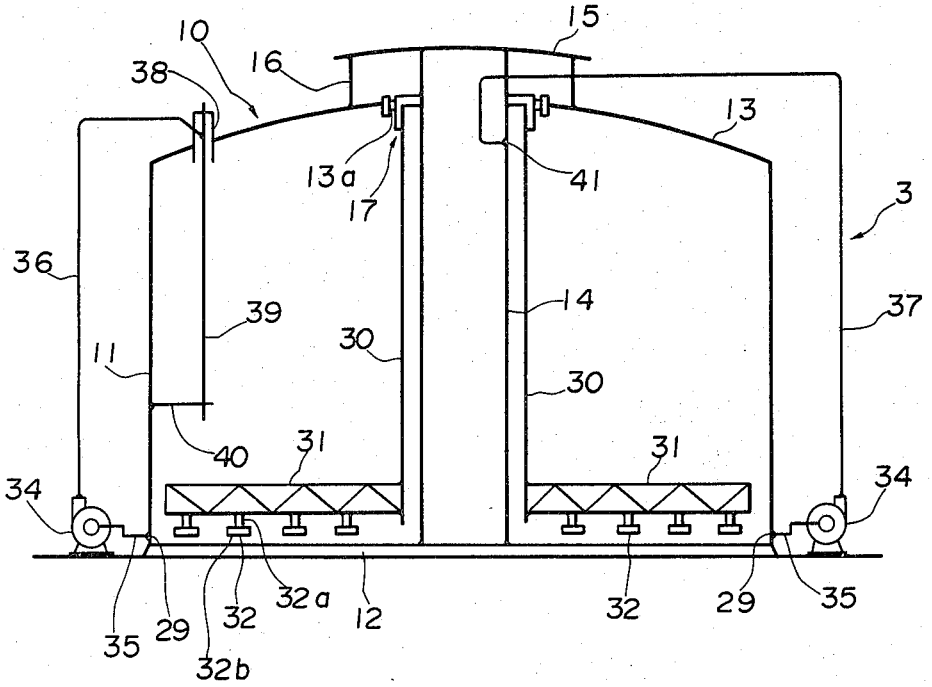
FIG. 1 is a schematic cross-sectional view of a slurry storage tank provided in accordance with the present invention.
Figure 2:
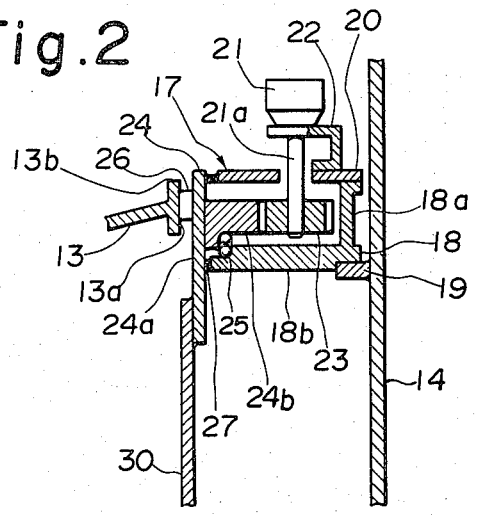
FIG. 2 is a fragmentary cross-sectional view of a drive mechanism of the storage tank.

A slurry storage tank 10 shown in FIG. 1 comprises a cylindrical side wall 11, a flat bottom wall 12 and a rounded top wall 13. A hollow cylindrical column 14 extends perpendicularly from the bottom wall 12 at its center, the upper portion of the column 14 extending through a central opening 13*a* of the top wall 13. The lower end of the column 14 is fixedly secured to the bottom wall 12 in a fluid tight manner. An upper open end of the column 14 is closed by a lid 15 which is fastened to the top wall 13 by fastening means 16.

The storage tank 10 comprises a drive mechanism 17 mounted on the upper portion of the column 14. The drive mechanism 17 comprises an annular mounting member 18 having a cylindrical portion 18*a* and a horizontal radial flange portion 18*b*. An annular support member 19 is fixedly secured around the upper portion of the column 14. The mounting member 18 is supported by the support member 19 with the cylindrical portion 18*a* fitted over the column 14. An annular cover member 20 is fixedly secured to the cylindrical portion 18*a* of the mounting member 18. An electric motor 21 with a speed reducer is mounted on the cover member 20 through a bracket 22. A pinion 23 is fixedly mounted on an output shaft 21*a* of the motor 21. An internal gear member 24 has a cylindrical portion 24*a* and a gear portion 24*b* formed on the inner surface of the cylindrical portion 24*a*. The internal gear member 24 is rotatably mounted on the mounting member 18 through a bearing member 25, the internal gear member 24 being disposed in coaxial relation to the column 14. The pinion 23 is in mesh with the gear portion 24*b* of the internal gear member 24. An annular sealing member 26 is interposed between the circular wall 13*b* defining the opening 13*a* of the top wall 13 and the cylindrical portion 24*a* of the internal gear member 24 to form an air-tight seal. Also, another sealing member 27 is interposed between the cylindrical portion 24*a* and the mounting member 18 to provide an air-tight seal. The storage tank 10 is completely sealed by these sealing members 26, 27. The motor 21 drives the internal gear member 24 through the pinion 23 for rotation about its axis. A pair of diametrically opposed connecting members 30, 30 are fixedly secured at their upper ends to the cylindrical portion 24*a* of the internal gear member 24 and extend downwardly along the axis of the column 14, the connecting member 30, 30 being in the form of a metal strip and terminating short of the bottom wall 12 of the storage tank 10. A pair of rake arms 31, 31 are fixedly secured at their one ends to the lower ends of the connecting members 30, 30, respectively, and extend radially outwardly relative to the column 14, the rake arms 31, 31 being disposed parallel to the bottom wall 12 of the storage tank 10. Each of rake arms 31, 31 comprises a framework of a square cross-section made of metal bars. A plurality of rake elements 32 are fixedly secured to the underside of each of the rake arms 31, 31 and spaced along the length thereof. Each of the rake elements 32 comprises a leg 32*a* depending from the rake arm 31 and a plate 32*b* secured to the lower end of the leg 32*a*. The plate 32*b* is disposed in parallel spaced relation to the bottom wall 12 of the storage tank 10. The plate 32*b* is inclined relative to the connecting member 30 for imparting a radial outward motion to a dense portion of the slurry on the bottom wall 12 or the solid material settled thereon. Mounted on the ground around the cylindrical storage tank 10 are a plurality of circulating pumps 34 for withdrawing the slurry from the storage tank and pumping back to the same. A first pipe 35 is connected at one end to the suction side of each pump 34 and at the other end to a discharge port 29 formed through the side wall 11 adjacent to the bottom wall 12. A plurality of second pipes 36, 37 are connected at their one ends to the delivery side of the pumps 34, respectively. The majority of the second pipes, which are indicated at 36, extend upwardly and have their upper ends received in respective cover member 38. A guide pipe 39 is connected at its one end to the upper end of each second pipe 36, the guide pipe 39 extending vertically into the storage tank 10. Each guide pipe 39 is supported at its lower end by a support member 40 extending horizontally from the side wall 11. The cover members 38 are arranged on the top wall 13 in such a manner that the guide pipes 39 are arranged radially and circumferentially of the column 14 for distributing the withdrawn slurry over the entire surface of slurry. With this arrangement, the distributed slurry imparts no substantial irregular motion to the slurry in the storage tank 10. The number of the guide pipes 39 is determined by the size of the storage tank 10 and the slurry surface level in the storage tank 10. The remaining second pipes indicated at 37 extend upwardly and are passed through the side wall of the column 14 above the top wall 13 and have their upper ends fitted in respective openings 41 formed through the side wall of the column 14 within the storage tank 10. The openings 41 are provided around the column 14 for causing the withdrawn slurry to flow along the outer circumferential surface of the column 14 to the surface of the slurry.

The operation of the slurry storage tank 10 will now be described.

The slurry storage tank 10 contains a slurry having a sedimentatable solid material suspended in a liquid medium. The motor 21 is energized through a power source (not shown) to rotate the internal gear member 24 at a low speed about its axis through the pinion 23 in mesh with the gear portion 24*b*. The rotation of the internal gear member 24 causes the rake arms 31, 31 to rotate through the connecting members 30, 30 so that the rake elements 32 impart a radial outward motion to the lower portion of the slurry on the bottom wall which tends to become dense. As a result, the lower portion of the slurry is directed radially to the discharge ports 29 provided around the side wall 11. The slurry is withdrawn from the dicharge ports 29 by the pumps 34. Then, the withdrawn slurry is delivered by the pumps 34 through the respective first pipes 35 and second pipes 36, 37 to the guide pipes 39 and the openings 41 in the column 14. The withdrawn slurry passing through the guide pipes 39 are distributed over the entire surface of the slurry in the storage tank 10. Also, the withdrawn slurry fed through the openings 41 moves downwardly along the outer circumferential surface of the column 14 to the slurry surface. By virtue of the provision of the guide pipes 39, the withdrawn slurry passes along the guide pipes 39 and quitely reaches the surface of the slurry in the storage tank 10. Without the guide pipes 39, the withdrawn slurry is caused to drop onto the slurry surface from the level of the top wall 13. This would impart vibration to the storage tank 10 and produce undesirable noise, and besides repeated stresses are exerted on the storage tank 10.

The slurry is withdrawn from the storage tank 10 at such a rate that a given portion of the slurry in the storage tank 10 moves downwardly at a speed greater than the speed of falling of the solid particles suspended in the slurry in the storage tank. The circulation of the slurry at this rate maintains the slurry in the storage tank 10 in a homogeneous state. For example, when the suspended particles moves downwardly at a speed of 1 m per hour, a give portion of the slurry in the storage tank 10 moves downwardly at a speed of more than 1 m per hour.

Since the rake arms 31, 31 are rotated at a quite low speed, the slurry in the storage tank 10 is subjected to no substantial agitation. Therefore, the slurry, distributed over the entire surface of the slurry in the storage tank 10 through the guide pipes 39 and the outer circumferential surface of the column 14, moves downwardly generally vertically toward the bottom of the storage tank 10. The slurry tends to remain stagnant near the bottom wall 12 of the storage tank 10, and therefore the rakes 32 direct such a dense slurry radially outwardly toward the discharge ports 29 so that the slurry withdrawn from the discharge ports 29 has a predetermined concentration. Thus, the slurry is circulated by the pumps 34 in the manner described above so that the slurry in the storage tank is maintained in a homogeneous state.

The storage tank 10 of the circulating type can be of a large size, produces no undesirable noise, and has a power consumption of 0.01 to 0.02 KW per 1 ton of the stored material which power consumption is much smaller than that of the conventional slurry storage tanks.

The drive mechanism 17, the connecting members 30, 30 and the rake arms 31, 31 are supported by the column 14. Thus, the top wall 13 of the storage tank 10 does not need to bear any load so that the storage tank 10 can be constructed in an economical manner.

While the slurry storage tank 10 according to this invention has been specifically shown and described herein, the invention itself is not to be restricted by the exact showing of the drawings or description thereof. For example, the number of the rake arms may be more than two.

What is claimed is:

1. A slurry storage tank for holding a slurry having a suspended sedimentatable solid material, said tank having a cylindrical side wall, a flat bottom wall and a top wall, said tank comprising:

(a) a hollow cylindrical column arranged centrally within said tank and fixedly secured at its lower end to the tank bottom wall, said column extending through the tank top wall at its upper portion;

(b) a drive mechanism mounted on the upper portion of said column;

(c) a connecting means operatively connected at its one end to said drive mechanism and extending downwardly toward the tank bottom wall;

(d) a plurality of rake arms connected to the lower end of said connecting means and extending radially outwardly relative to said column, said rake arms being rotated at a low speed by said drive mechanism through said connecting means, each of said rake arms having at its underside a plurality of rake elements for directing the lower portion of the slurry on the bottom wall radially toward the tank side wall;

(e) a pumping means located exteriorly of said tank;

(f) a first pipe means connected between the suction side of said pumping means and the lower portion of the tank side wall for withdrawing the slurry from said tank;

(g) a second pipe means connected at one end to the delivery side of said pumping means and extending to a position above the tank top wall; and (h) a plurality of vertical guide pipes connected to the other end of said second pipe means, said guide pipes extending through the tank top wall into said tank and arranged radially and circumferentially of said column for distributing the slurry over the entire surface of the slurry in said tank whereby the slurry in said tank is maintained in a homogeneous state.

2. A slurry storage tank according to claim 1, in which said drive mechanism comprises a mounting member fixedly secured around said column and having a horizontal radial flange portion; an electric motor mounted on said mounting member; a pinion connected in driving relation to said motor; an internal gear member having a cylindrical portion disposed around said mounting member in coaxial relation to said column, and an internal gear portion formed on the inner circumferential surface of said cylindrical portion and being in mesh with said pinion, said internal gear portion being disposed in overlying relation to said radial flange portion; and a bearing means interposed between said internal gear portion and said mounting portion for rotatably supporting said internal gear member; said connecting means being connected to said cylindrical portion, whereby the internal gear member is rotated about said column by said motor through said pinion and said internal gear portion.

3. A slurry storage tank according to claim 1, in which said pumping means comprises a plurality of pumps located around said tank.

4. A slurry storage tank according to claim 3, in which each of said first and second pipe means comprises a plurality of pipes.

5. A slurry storage tank according to claim 4, in which a plurality of circumferentially spaced openings are formed through said column at a level below said tank top wall, some of the pipes of said second pipe means extending into said column above the tank top wall and having their upper ends fitted in said openings, respectively, for causing the withdrawn slurry to move downwardly along the outer circumferential surface of said column.

* * * * *